US008556419B2

(12) United States Patent
Haddadi

(10) Patent No.: US 8,556,419 B2
(45) Date of Patent: Oct. 15, 2013

(54) METHOD OF PREPARING AN OPHTHALMIC LENS WITH SPECIAL MACHINING OF ITS ENGAGEMENT RIDGE

(75) Inventor: Ahmed Haddadi, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 733 days.

(21) Appl. No.: 12/864,579

(22) PCT Filed: Jan. 9, 2009

(86) PCT No.: PCT/FR2009/000025

§ 371 (c)(1),
(2), (4) Date: Jul. 26, 2010

(87) PCT Pub. No.: WO2009/106765

PCT Pub. Date: Sep. 3, 2009

(65) Prior Publication Data

US 2010/0309430 A1 Dec. 9, 2010

(30) Foreign Application Priority Data

Jan. 28, 2008 (FR) ..... 08 00450

(51) Int. Cl.
*G02C 13/00* (2006.01)

(52) U.S. Cl.
USPC ..... 351/178; 351/159.73

(58) Field of Classification Search
None
See application file for complete search history.

(56) References Cited

U.S. PATENT DOCUMENTS 5,926,247 A * 7/1999 Kimura ..... 351/41
6,142,628 A * 11/2000 Saigo ..... 351/204
2001/0036794 A1 11/2001 Hatano

OTHER PUBLICATIONS

International Search Report dated Jul. 16, 2009, from corresponding PCT application.

* cited by examiner

*Primary Examiner* — James Greece
(74) *Attorney, Agent, or Firm* — Young & Thompson

(57) ABSTRACT

A method of preparing an ophthalmic lens for mounting in a surround of an eyeglass frame includes an acquisition step of acquiring a first longitudinal profile of the surround and an orientation parameter of the first longitudinal profile relative to a horizon line or a verticality line of the surround, and an edging step of edging the ophthalmic lens so as to form a generally profiled engagement ridge of desired section that extends along a second longitudinal profile (25) that is derived from the first longitudinal profile and of orientation that is derived from the orientation parameter. The method includes a determination step of determining at least one singular portion (Z1-Z12) of the second longitudinal profile as a function of the orientation parameter. During the edging step, the engagement ridge is locally pared away in the singular portion.

21 Claims, 7 Drawing Sheets

Fig.6
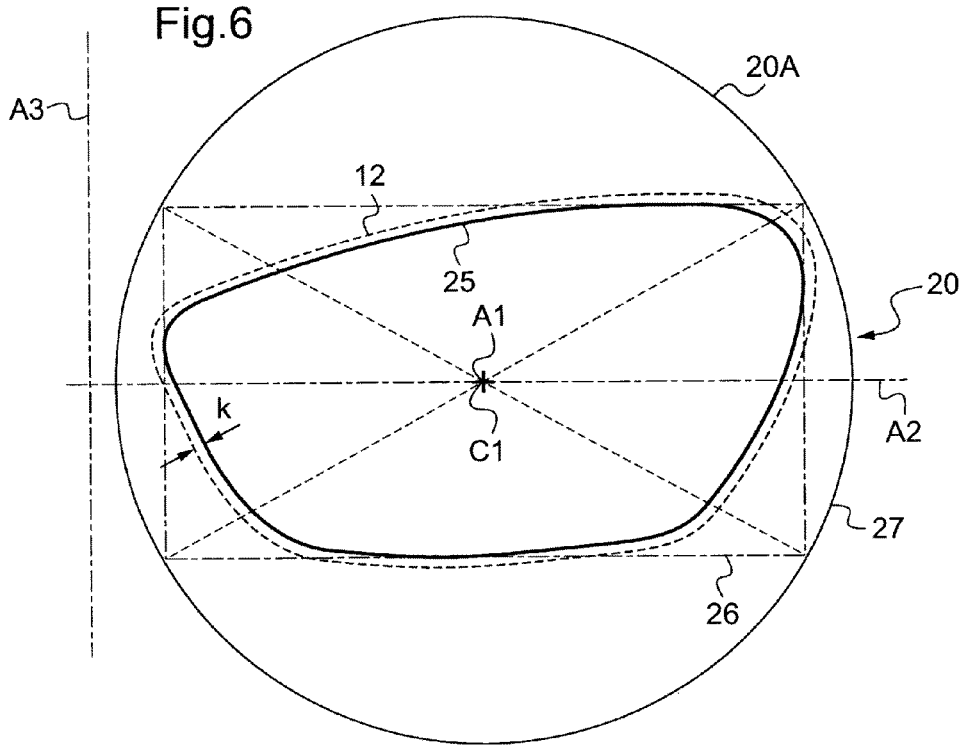
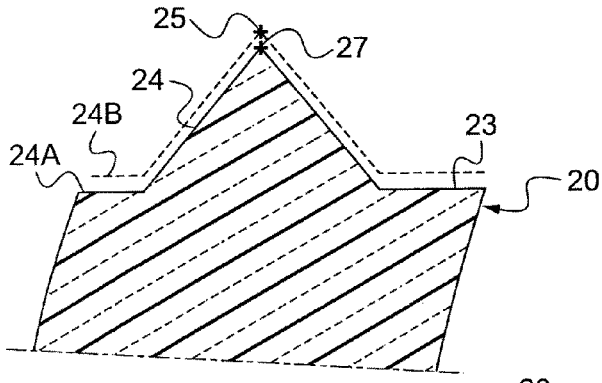
Fig.7A
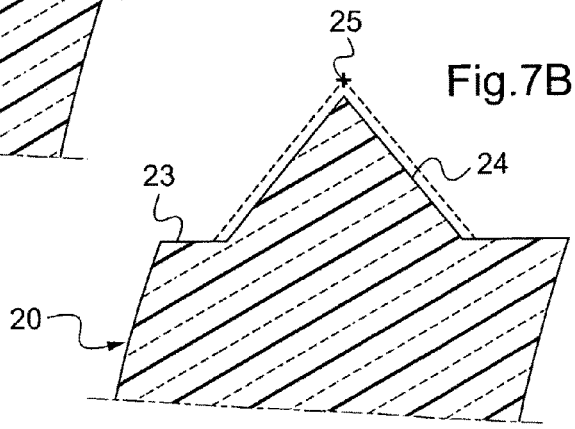
Fig.7B

METHOD OF PREPARING AN OPHTHALMIC LENS WITH SPECIAL MACHINING OF ITS ENGAGEMENT RIDGE

TECHNICAL FIELD TO WHICH THE INVENTION APPLIES

The present invention relates in general to the field of mechanical optics, and more precisely to preparing ophthalmic lenses for engagement in the surrounds of rimmed eyeglass frames.

Technological Background

The technical portion of the profession of an optician consists in mounting a pair of correcting ophthalmic lenses on a rimmed eyeglass frame as selected by a wearer. Such mounting comprises three main operations:

- acquiring the shape of the internal outlines of the surrounds of the frame;
- centering each lens, which operation consists in positioning and orienting each lens appropriately in front of each eye of a wearer; and then
- machining each lens, which consists in cutting out or shaping its outline to the desired shape, taking account of the shapes of the surrounds and of the defined centering parameters.

The specific object of the optician is to edge the ophthalmic lens in such a manner as to enable it to be fitted mechanically and pleasingly to the shape of the corresponding surround of the selected frame, while also ensuring that the lens performs the optical function for which it is designed as well as possible.

With rimmed frames, the machining operation includes in particular a bevelling step that serves to form an engagement ridge, commonly called a bevel, on the edge face of the lens and suitable for engaging in a groove, commonly called a bezel, that runs along the inside face of the corresponding surround of the frame.

Both the acquisition and the machining operations need to be performed with particular care so as to ensure that the lens can be properly engaged in its surround, without force, and at the first attempt, i.e. without requiring a subsequent reworking.

In order to acquire the shape of the bezel, it is general practice to use an outline reader appliance that includes a feeler that picks up the shape of the bezel. Nevertheless, at the end of this feeling operation, errors are observed in the measurement of the shape of the outline. These errors are inherent to the reader appliance that may present resolution that is not sufficient, or assembly defects, or indeed that may be damaged or out of adjustment. In addition, while the bezel is being felt, any deformation of the frame (as a result of the feeler bearing against the bezel) likewise give rise to errors.

At the end of the machining operation, edging errors are also observed, such that the actual shape of the edge face of the lens does not correspond exactly to the desired shape. These errors are likewise inherent to the shaper appliance that may present resolution that is insufficient, or assembly defects, or that may include a grindwheel that is worn in shape. Furthermore, the bending deformations of the lens (due to the grindwheel bearing against the edge face of the lens while it is being machined) also give rise to errors, as do the phenomena of lenses expanding while they are being machined.

To sum up, and given the various errors and inaccuracies, a lens as machined in this way presents an outline that rarely corresponds exactly the outline of the bezel of its surround. It runs the risk of being either too big, thereby constraining the optician to perform additional and time-consuming machining of the engagement ridge, or too small.

In order to increase the yield of lenses that are correctly edged at the first attempt, it is known to correct the defects of acquisition and shaper appliances in such a manner as to increase their resolutions and so as to enable them to take a greater number of parameters into consideration. It is also known to calibrate the appliances frequently. Nevertheless, such methods are lengthy, complex, and expensive to implement. Furthermore, the parameters actually taken into consideration are not exhaustive. As a result, the yield of lenses that are correctly edged at the first attempt is still not satisfactory.

Furthermore, a large fraction of lenses that are considered as being mountable in their surrounds are in fact slightly too big relative to their surrounds, such that once they have been engaged therein, they are mechanically under stress. As a result, such lenses are weakened and their treatment layers are likely to be damaged more quickly. Furthermore, these mechanical stresses modify the optical characteristics of lenses to some extent and that can be troublesome for their wearers.

It is also known to acquire the shapes of the bezels of the surrounds of an eyeglass frame by means of a database registry containing a plurality of records, each associated with a particular model of eyeglass frames. Nevertheless, as a result of manufacturing dispersions, it is observed that no two eyeglass frames of a given model ever present exactly the same shape. Consequently, the shapes acquired from the database are generally slightly different from the real shapes of the bezels of the particular eyeglass frame as selected by the wearer. As a result, lenses machined as a function of such acquired shapes are not always mountable in the surrounds of the selected frame, such that it is often necessary to rework the machining of their engagement ridges.

It is also known to acquire the shape of the bezel of one of the surrounds of an eyeglass frame as a function of the shape previously acquired for the bezel of the other surround of the eyeglass frame, assuming both surrounds are symmetrical. Nevertheless, as a result of manufacturing dispersions, it is observed that the two surrounds of the same eyeglass frame are never completely symmetrical. Consequently, the shape of a bezel as derived by symmetry is generally slightly different from the real shape of the bezel of the second surround. As a result, a lens machined as a function of such a derived shape is not always mountable in the corresponding surround of the frame, such that it is often necessary to rework the machining of its engagement ridge.

OBJECT OF THE INVENTION

In order to remedy the above-mentioned drawbacks of the state of the art, the present invention proposes a method of preparing ophthalmic lenses that serves to increase the probability that said lenses will engage directly at the first attempt in their surrounds without being subjected to excessive mechanical stresses.

More particularly, the invention provides a method of preparing an ophthalmic lens for mounting in a surround of an eyeglass frame, the method comprising an acquisition step of acquiring a first longitudinal profile of said surround and an orientation parameter of said first longitudinal profile relative to a horizon line or to a verticality line of said surround about an orientation axis that is substantially perpendicular to a mean plane of said surround and an edging step of edging the ophthalmic lens with an engagement ridge being formed on its edge face, the ridge being generally profiled with a desired section and extending along a second longitudinal profile that is derived from the first longitudinal profile and whose orientation relative to the ophthalmic lens about said orientation axis is derived from said orientation parameter.

According to the invention, the method includes a determination step of determining at least one singular portion of the second longitudinal profile as a function of said orientation parameter, and during the edging step, the engagement ridge is formed so as to present a section that is reduced in width and/or in height over said singular portion. In a variant, during the edging step, the engagement ridge is formed so that the second longitudinal profile is derivable from the first longitudinal profile by a mathematical relationship that is different over said singular portion than for the remainder of the second longitudinal profile in such a manner that the mean radius of curvature of said singular portion of the second longitudinal profile is increased relative to the mean radius of curvature that said singular portion would have presented if said mathematical relationship had been the same over said singular portion as over the remainder of the second longitudinal profile.

This compensates the errors inherent to the operation of the reader and shaper appliances not by increasing the accuracy of those appliances, but rather by accommodating said errors by paring away the engagement ridge in singular portions that are particularly sensitive for assembling the lens in its frame.

These singular portions are zones of interference between the bezel and the surround of the frame when the lens is being engaged in its surround. According to the invention, the positions of these singular portions are derived from the orientation of the second longitudinal profile relative to the frame of reference of the eyeglasses. This derivation may thus be performed easily using a simple calculation algorithm, such that the derivation step may be implemented particularly quickly.

In these portions, paring away the engagement ridge makes it possible, once the lens has been engaged in its surround, for the engagement ridge not to come into contact with the bezel over its entire periphery, but rather for spaces to appear between the engagement ridge of the lens and the bezel of the surround of the frame within said singular portions. As a result, the singular portions are referred to as free portions and they provide free clearance between the engagement ridge and the bezel.

Consequently, if the engagement ridge should, by error, be machined with an outline that is slightly too big relative to the outline of the bezel, these spaces enable the outline to deform locally so as to compensate for said machining error. In this way, the lens may be engaged in its surround without that giving rise to excessive mechanical stresses on the lens.

In order to pare away the engagement ridge, it is possible locally to reduce the section of the engagement ridge of the lens in the singular portions of the second longitudinal profile. It should then be understood that the engagement ridge can engage more deeply into the bezel of the surround in these singular portions.

In order to pare away the engagement ridge, it is also possible to calculate the shape of the second longitudinal profile in a special manner in the singular portions of the second longitudinal profile so that the radius of curvature of the second longitudinal profile is locally increased. In this way, during the edging step, the lens is locally machined to a greater depth so as to cause a small space to appear between the surround of the frame and the edge face of the lens when the lens is mounted in the surround.

DETAILED DESCRIPTION OF AN EMBODIMENT

The following description with reference to the accompanying drawings given by way of non-limiting example makes it clear what the invention consists in and how it can be reduced to practice.

In the accompanying drawings:

FIG. 6 is a face view of a non-edged ophthalmic lens, on which there can be seen a longitudinal profile of a bezel of a surround of an eyeglass frame, a longitudinal profile of an engagement ridge that the ophthalmic lens will present once it has been edged, and a boxing frame circumscribing the longitudinal profile of the engagement ridge;

FIGS. 7A and 7B are section views of the edge faces of two ophthalmic lenses edged using two different implementations;

Figure 1:
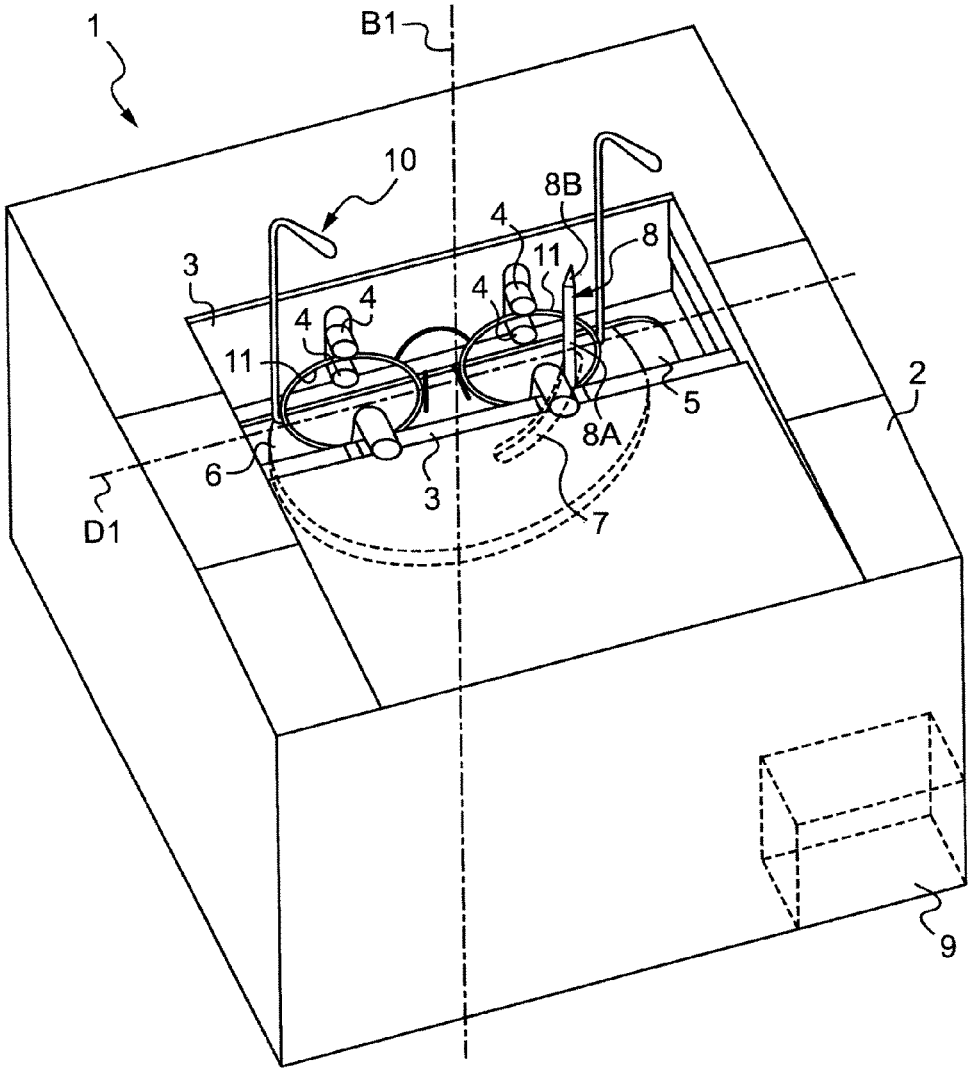
FIG. 1 is a perspective view of a reader appliance for reading the outline of bezels of eyeglass frames.

An object of the present invention is to facilitate engaging an ophthalmic lens in a surround of an eyeglass frame, and to improve the quality of that engagement.

The invention applies thus more particularly to rimmed eyeglass frames 10 (FIG. 1) having two surrounds 11 that are connected together by a bridge, and each of which is fitted with a temple. Conventionally, each surround 11 has a generally V-section groove running around its inside and commonly referred to as a bezel 11. The bezel extends along a curvilinear longitudinal profile 12. Such a bezel 13 is shown in section in FIG. 8A.

The longitudinal profile 12 corresponds to a contour of the bezel, extending over one and/or the other flank of the bezel and substantially parallel to or coinciding with the bottom edge of the bezel.

Relative to this longitudinal profile 12, it is possible to define a horizon line A2 (FIG. 6) that is substantially horizontal when the eyeglass frame 10 is worn by the wearer in the orthostatic position, i.e. when the wearer is upright and holding the head straight. The horizon line A3 in this example corresponds more particularly to the straight line passing in front of the two pupils of the wearer.

It is also possible to define a mean plane relative to each surround 11, which mean plane is orthogonal to the two temples of the eyeglass frame 10 when they are in the deployed position, and it is tangential to the bridge of the frame.

Finally, a verticality line A3 (FIG. 6) may be defined that is substantially vertical when the eyeglass frame 10 is worn by the wearer in the orthostatic position and that lies in the plane of symmetry of the eyeglass frame.

Figure 2:
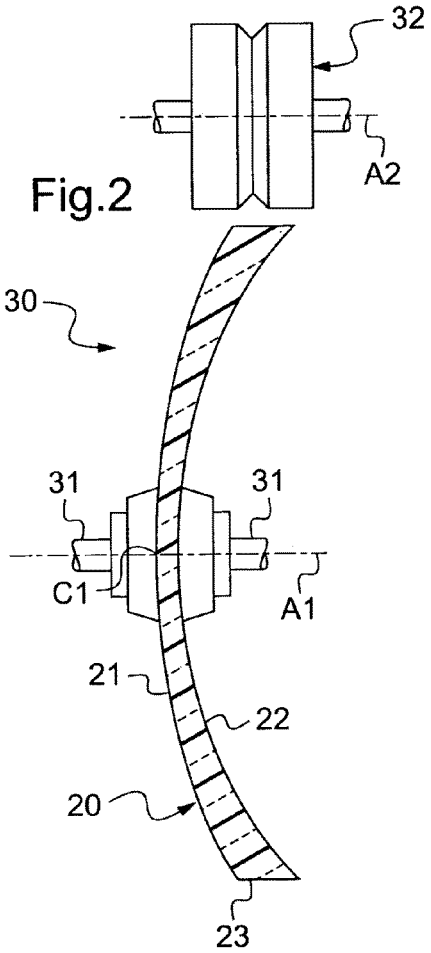
FIG. 2 is a diagrammatic view of an ophthalmic lens held in a shaper appliance provided with a beveling grindwheel.

As shown in FIG. 2, the ophthalmic lens 20 presents a front optical face 21 that is convex and a rear optical face 22 that is concave, and a peripheral edge face 23 of initial outline 20A (FIG. 6) that is generally circular.

As shown in FIGS. 7A, 7B and 8A, 8B, the ophthalmic lens, after its edge face 23 has been machined, is to have an engagement ridge 24 that extends along a curvilinear longitudinal profile 25; 27 of shape that enables the ophthalmic lens 20 to be engaged in the corresponding surround 11 of the eyeglass frame 10.

This longitudinal profile 25; 27 corresponds to a line that runs along the edge face 23 of the lens and that meets a defined point of each cross-section of the engagement ridge 24. Each of these points in this example is defined by a rule that is uniform for all of the cross-sections of the engagement ridge 24. By way of example, the longitudinal profile 25 may correspond to one of the contours of the engagement ridge 24 that extends over one and/or the other of the flanks of said engagement ridge, and that is substantially parallel to or coincides with the top of the engagement ridge.

As shown in FIG. 6, a boxing frame 26 may be defined relative to the longitudinal profile 25.

The boxing frame 26 is defined more precisely as being the rectangle that firstly circumscribes the orthogonal projection of the derived longitudinal profile 25 in the plane of the initial outline 20A, and secondly presents two sides that are parallel to the horizontal line A2 and two sides that are parallel to the verticality line A3.

At the intersection of its two diagonals, the boxing frame 26 presents a geometrical center C1 through which there passes a central axis A1 of the lens (FIG. 2), also called orientation axis or blocking axis. The central axis A1 is substantially normal to the mean plane of the surround 11 in question and passes through the geometrical center C1.

Device

In order to prepare such a lens, it is known to use an outline reader appliance 1, e.g. as shown in FIG. 1.

The appliance comprises a top cover 2 covering the entire appliance with the exception of a central top portion that is accessible to the user, and in which the eyeglass frame 10 is placed.

The outline reader appliance 1 serves to read the shapes of the outlines 11 of the bezels 13 of the surrounds of the eyeglass frame 10.

For this purpose it has a set of two jaws 3, one of which is movable, the jaws being provided with movable studs 4 that serve to clamp the eyeglass frame 10 between them in order to hold it stationary.

In the space left visible by the central top opening in the cover 2, there can be seen a structure 5. A plate (not visible) is movable in translation on the structure 5 along a transfer axis D1. This plate has a turntable 6 mounted to turn thereon. The turntable 6 is thus suitable for occupying two positions along the transfer axis D1, each in register with a respective one of the two surrounds 11 of the eyeglass frame 10.

The turntable 6 possesses an axis of rotation B1 defined as being the axis normal to the front face of the turntable 6 and passing through its center. It is suitable for pivoting about said axis relative to the plate. The turntable 6 also includes an oblong slot 7 in the form of a circular arc with a feeler 8 projecting therethrough. The feeler 8 comprises a support rod 8A of axis perpendicular to the plane of the front face of the turntable 6, and at its free end, a feeler finger 8B of axis perpendicular to the axis of the support rod 8A. The feeler finger 8B serves to slide, or possibly to roll, along the bottom of the bezel 13 in each of the two surrounds 11 of the eyeglass frame 10, by moving along the slot 7.

The outline reader appliance 1 includes actuator means (not shown) suitable, firstly to cause the support rod 8A to slide along the slot 7 so as to modify its radial position R relative to the axis of rotation B1 of the turntable 6, secondly to vary the angular position THETA of the turntable 6 about its axis of rotation B1, and thirdly to position the feeler finger 8B of the finger 8 at a greater or lesser altitude Z relative to the plane of the front face of the turntable 6. Each point felt by the end of the feeler finger 8B of the feeler 8 is thus identified in a corresponding system of cylindrical coordinates. The coordinates of each felt point of the bezel 13 are then written $ra_i$, $thetaa_i$, $za_i$.

The outline reader appliance 1 also includes an electronic and/or computer device 9 serving firstly to control the means for actuating the outline reader appliance 1, and secondly to acquire and record the coordinates $ra_i$, $thetaa_i$, $za_i$ of each felt point of the bezel 13.

In order to prepare the ophthalmic lens 20, it is also known to make use of a shaper appliance 30 that does not form part of the present invention, per se. Such a shaper appliance, is well known to the person skilled in the art, and is described for example in document U.S. Pat. No. 6,327,790, or sold by the Applicant under the trademark Kappa CTD.

As shown in FIG. 2, such a shaper appliance 30 generally includes support means, constituted in this example by shafts 31 for holding the ophthalmic lens 20 and for driving it in rotation about a blocking axis A1 coinciding with the central axis of the lens. Such a shaper appliance also includes shaper means, formed in this example by a machining tool 32 mounted to rotate about an axis of rotation A4 that is substantially parallel to the blocking axis A1, but that could equally well be inclined relative to said axis.

The machining tool 32 and/or the shafts 31 are provided with two freedoms of relative movements, including a radial freedom of movement enabling the spacing between the axis of rotation A4 and the blocking axis A1 to be modified, and a freedom of movement in axial translation along an axis parallel to the blocking axis A1.

The shaper appliance 30 also includes an electronic and/or computer device (not shown) that is provided firstly with communications means for communicating with the electronic and/or computer device 9 of the outline reader appliance 1, and secondly with the means for controlling the movements of the shafts 31 and of the machining tool 32. For each angular position of the lens 20 about the blocking axis A1, this electronic and/or computer device serves in particular to control the radial spacing between the machining tool 32 and the blocking axis A1, and also the axial position of the edge face 23 of the lens relative to the working surface of the machining tool 32.

Figure 3:
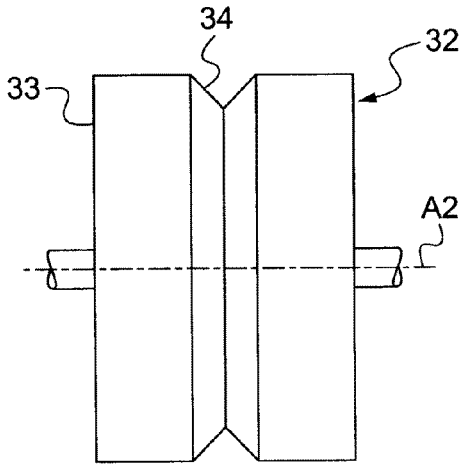
FIGS. 3 to 5 are side views of three beveling grindwheels.

As shown more particularly in FIG. 3, the machining tool 32 is, in this example, constituted by a main grindwheel 33 that is shaped, i.e. that presents a recessed machining profile of a shape that, like a negative, is complementary to the shape that is to be obtained in relief on the edge face 23 of the lens that is to be machined. This main grindwheel 33 constitutes a body of revolution about the axis of rotation A4 and it is provided with a beveling groove 34 suitable for forming an engagement ridge 24 (FIG. 8A) of complementary shape on the edge face 23 the lens 20. The diameter of the main grindwheel is preferably selected to be less than 25 millimeters.

This engagement ridge 24 is usually made to present, in cross-section, a profile in the form of an upside-down V-shape, which is why the engagement ridge 24 is commonly referred to as a bevel. Naturally, this engagement ridge could present some other shape in cross-section, e.g. a semicircular shape or a rectangular shape.

Figure 4:
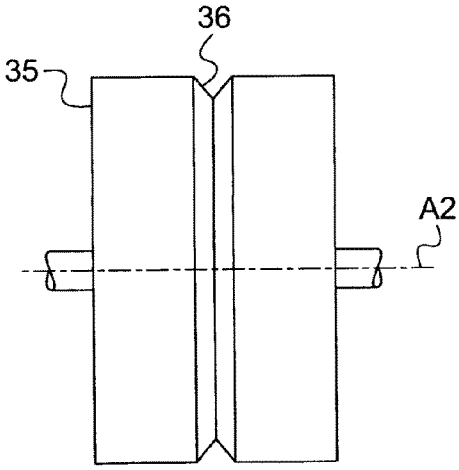

In a variant, and with reference to FIG. 4, provision may be made for the machining tool to include a set of grindwheels, including not only the above-mentioned main grindwheel 33, but also an auxiliary grindwheel 35 having a beveling groove 36 of depth and/or width that are less than that depth and/or width of the beveling groove 34 of the main grindwheel 33. This small beveling groove 36 may for example present a depth and a width that are 0.3 millimeters less than the depth and the width of the beveling groove 34 of the main grindwheel 33.

Figure 5:
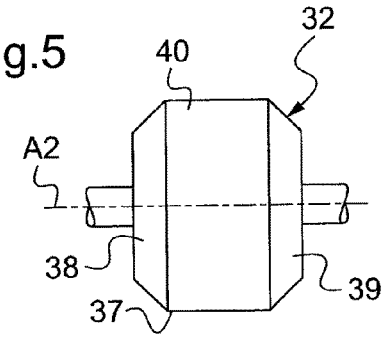

In another variant, as shown in FIG. 5, provision may be made for the machining tool 32 to include a wheel 37 presenting a central portion 40 that is circularly cylindrical about the axis of rotation A4, and on either side of its central portion 40, two end portions 38 and 39 that are circularly frustoconical about the axis of rotation A4 and that are disposed large base to large base. These two end portions 38 and 39 are then suitable for machining the two flanks of the engagement ridge 24 of the ophthalmic lens 20 in succession. Naturally, provision may also be made for these two end portions to be disposed facing each other and spaced apart from each other.

The machining tool may be of some other type. In particular, it could be formed by a milling or cutter tool mounted to rotate about the axis of rotation A4. The term "cutter tool" is used for a tool that presents, like a flat bit, a central shaft with two blades projecting radially therefrom on either side in a common plane and whose free opposite edges are suitable for machining the edge face of the ophthalmic lens.

Method of Preparation

The method of preparing the ophthalmic lens is performed in four main steps. In particular, it comprises an acquisition step of acquiring the shape of a longitudinal profile 12 of the bezel 13 (referred to as the acquired longitudinal profile), a deriving step of deriving the shape of a longitudinal profile 25 of the engagement ridge 24 (referred to as the derived longitudinal profile), this shape being derived as a function of the shape of the acquired longitudinal profile 12, a determination step of determining singular portions Z1-Z56 on said derived longitudinal profile 25, and an edging step of edging the ophthalmic lens 20 in a special way in the singular portions Z1-256.

During a first step of acquiring the shape of an acquired longitudinal profile 12 of the bezel 13, the eyeglass frame 10 selected by the future wearer is engaged in the reader appliance 1 (FIG. 1). To do this, the frame 10 is inserted between the studs 4 of the jaws 3 in such a manner that one of its surrounds 11 is ready to be felt along a path that starts by inserting the feeler 8 between the two studs 4 clamped to the bottom portion of said surround, after which it follows the outline of the bezel 13 of said surround 11.

More precisely, the electronic and/or computer device 9 defines as zero the angular position and the altitude of the feeler 8 when the feeler finger 8B is placed between the two above-mentioned studs 4.

Once the eyeglass frame 10 has been fastened and the feeler 8 is in contact with the bezel 13, the electronic and/or computer device 9 causes the turntable 6 to turn so that the feeler finger 8B of the feeler 8 moves continuously along the bottom of the bezel 13.

Contact between the feeler finger 8B and the bottom of the bezel 13 is conserved by actuator means applying a radial return force on the feeler 8 that is directed towards the bezel 13. This radial return force thus serves to prevent the feeler finger 8B from rising along one or the other of the flanks of the bezel 13, and serves to prevent it from escaping from the bezel.

Consequently, the feeler 8 is controlled in angular position about the axis of rotation B and it is guided depending on its radial coordinates and its altitude, in this example, by means of the V-shape of the bezel 13.

While the turntable 6 is turning, the electronic and/or computer device 9 then reads the three-dimensional coordinates $ra_i$, $thetaa_i$, $za_i$ of a plurality of points of the acquired longitudinal profile 12 of the bezel 13, e.g. 360 points, in order to store an accurate digital image of this profile. This image, in orthogonal projection onto the plane of the initial outline 27 of the ophthalmic lens 20, is drawn as a dashed line in FIG. 6.

Given the position of the frame 10 in the reader appliance 1, with its two surrounds 11 extending along the transfer axis D1, the electronic and/or computer device 9 can acquire an orientation parameter for said acquired longitudinal profile 12 relative to the horizon line A2 about the central axis A1. In this example, this orientation parameter has the coordinates $ra_{91}$, $thetaa_{91}$, $za_{91}$ and $ra_{271}$, $thetaa_{271}$, $za_{271}$ of two of the points of the acquired longitudinal profile 12 (the straight line passing through these two points is parallel to the horizon line).

In a variant, the electronic and/or computer device 9 may acquire the orientation parameter of this reference acquired longitudinal profile 12, not at the horizon line, but rather at the verticality line A3. In this variant, the orientation parameter may comprise the coordinates $ra_1$, $thetaa_1$, $za_1$ and $ra_{181}$, $thetaa_{181}$, $za_{181}$ of the two points of this acquired longitudinal profile 12 (the straight line passing through these two points being parallel to the verticality line).

In order to acquire the three-dimensional coordinates of the 360 points of the acquired longitudinal profile 12, it is possible in a variant to make use of a database registry. In this variant, the database registry comprises a plurality of records, each associated with a referenced type of eyeglass frame (i.e. a shape or a model of eyeglass frames). More precisely, each record includes an identifier that corresponds to the referenced type of eyeglass frame, and a table of values referencing the three-dimensional coordinates of the 360 characteristic points of the shape of the longitudinal profiles of the bezels of eyeglass frames of the referenced type (the value of the orientation parameter can in particular be deduced from these coordinates). Thus, in this variant, in order to acquire the three-dimensional coordinates $ra_i$, $thetaa_i$, $za_i$ of the points of the acquired longitudinal profile 12, the operator searches in the database for the record having its identifier correspond to the eyeglass frame selected by the wearer (e.g. by means of the frame bar code). Thereafter, the reference values in this record are read and transferred to the electronic and/or computer device of the shaper appliance 30.

A drawback that is generally observed when using this method of acquisition is that, since two frames of the same type rarely present exactly the same shape, the three-dimensional coordinates acquired from the database may be slightly different from the real coordinates of the corresponding points of the bezel. Nevertheless, by means of the invention and as set forth below, these small differences will not result in any problems for the ophthalmic lens 20 to engage in the surround 11 of the frame 10 selected by the wearer.

In another variant, the coordinates of the points of the acquired longitudinal profile may be acquired in a plane, e.g. on a photograph of the wearer. In this variant, firstly, a digital photograph is acquired of the wearer wearing the eyeglass frame. Then, secondly, the shape of the inner outline of each surround of the eyeglass frame is read from the acquired photograph, e.g. by means of image processing software. The coordinates $ra_i$, $thetaa_i$ of a plurality of points of the acquired longitudinal profile are thus determined. This photograph also provides the position of the horizon line defined as being the line passing through the two pupils of the wearer.

During a second derivation step for deriving the shape of the derived longitudinal profile 25, the shape that should be presented by the top edge of the engagement ridge 24 is calculated so that said ridge may engage the previously felt bezel 13. This shape will thus make it possible to determine a setpoint for shaping the ophthalmic lens 20.

This derivation step may be performed by calculation means of the electronic and/or computer device hosted by the outline reader appliance 1 or by those of the shaper appliance 30, or indeed by those of any other device suitable for communicating with one and/or the other of these two appliances 1, 30.

During this second step, the calculation means respond to the three-dimensional coordinates $ra_i$, $thetaa_i$, $za_i$ of the points of the acquired longitudinal profile 12 to determine the shape of the derived longitudinal profile 25 (FIG. 6), i.e. the shape that should be presented by the top edge of the engagement ridge 24 once it has been shaped. This shape will enable the calculation means of the electronic and/or computer device accommodated by the shaper appliance 30 to derive radial and axial setpoints therefrom for shaping the ophthalmic lens 20.

In this example, the derived longitudinal profile 25 is defined by 360 points of three-dimensional coordinates written $rs_j$, $thetas_j$, $zs_j$.

The derived longitudinal profile 25 is derived from the acquired longitudinal profile 12 in the sense that it is defined either to coincide therewith, or else to be spaced apart therefrom by a spacing that is practically constant. More precisely, the coordinates $rs_j$, $thetas_j$, $zs_j$ of the 360 points of the derived longitudinal profile 25 are calculated from the coordinates $ra_i$, $thetaa_i$, $za_i$ of the 360 points of the acquired longitudinal profile 12 using the following mathematical relationship:

For i=j and for j from 1 to 360

$$rs_j=ra_i+k;$$

$$thetas_j=thetaa_i;$$

$$zs_j=za_i+f(thetas_i).$$

This mathematical relationship thus has two components $rs_j$, $thetas_j$ in the mean plane that are uniform.

Figure 8A:
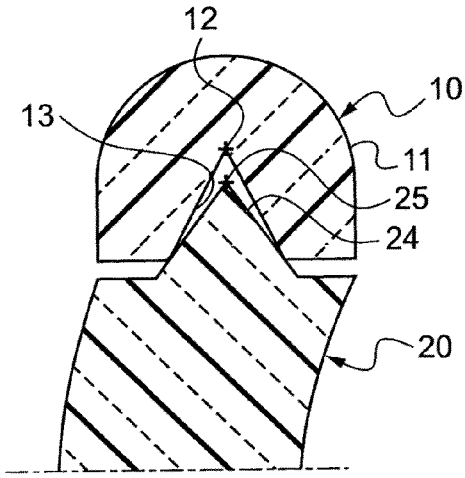
FIGS. 8A and 8B are section views of an engagement ridge of an ophthalmic lens engaged in a bezel of an eyeglass frame respectively at a section lying outside a singular portion and at a section lying in a singular portion.
Figure 8B:
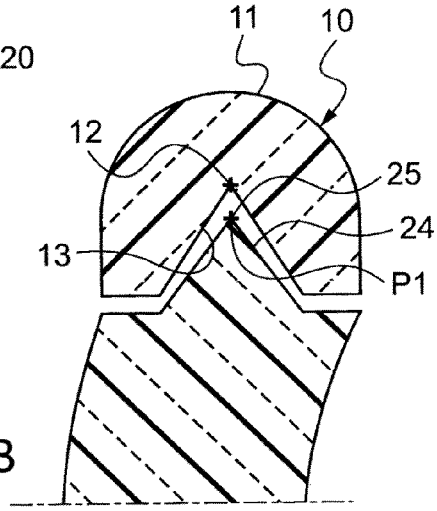

The constant k is calculated in conventional manner as a function of the architectures of the outline reader appliance 1 and of the shaper appliance 30, and as a function of the shapes of the cross-sections of the bezel in the surround of the frame and of the beveling groove of the main grindwheel 33. This constant k serves in particular to take account of the fact that once the lens is engaged in the surround, the top of the engagement ridge (corresponding to the derived longitudinal profile 25) never comes into contact with the bottom of the bezel (corresponding to the acquired longitudinal profile 12) but is slightly offset therefrom (FIGS. 8A and 8B).

The function $f(thetas_j)$ may be selected to be zero, or constant, or variable, in order to take account of a difference, if any, between the general cambers of the lens and of the bezel of the frame. This function is selected in particular so as to enable the position of the engagement ridge 24 on the peripheral edge face 23 of the ophthalmic lens 20 to be modified, e.g. in such a manner that the engagement ridge 24 extends along the front optical face of the lens, or else rather in the middle of its edge face.

The positioning (also known as centering) of this derived longitudinal profile 25 on the ophthalmic lens 20 is conventionally performed as a function of an optical frame of reference of the ophthalmic lens 20 and of the previously-acquired orientation parameter. An example of such positioning is described in document EP 1 866 694.

During a third step, the calculation means proceed to detect at least one singular portion Z1-Z12 (FIG. 9) of the derived longitudinal profile 25 as a function of said orientation parameter.

This detection makes it possible subsequently to machine the ophthalmic lens 20 in such a manner that its engagement ridge 24 is ideally in contact with the bezel 13 outside the singular portions (see FIG. 8A) and is not in contact with the bezel 13 in said singular portions (see FIG. 8B). It can thus be understood that the engagement ridge 24 is machined in conventional and uniform manner except in the singular portions of the derived longitudinal profile 25, in such a manner that the engagement ridge 24 engages in the bezel 13 and is machined in a special and non-uniform manner in the singular portions of the derived longitudinal profile 25, such that ideally the engagement ridge 24 does not engage fully in the bezel 13 in said singular portions.

The sections of the engagement ridge 24 that are to come into contact with the bezel 13 are referred to as bearing sections, whereas the sections of the engagement ridge 24 that are not to come into contact with the bezel 13 are referred to as free sections. These free sections are named in this way since, if the lens is not properly edged and presents an outline that is too great compared with that of the corresponding surround 11, then the surround is free to deform in the free sections so as to match the shape of the engagement ridge. In this sense, the singular portions could also be referred to as free portions.

The positions of the singular portions Z1-Z13 of the derived longitudinal profile 25 may be determined in various ways.

Figure 9:
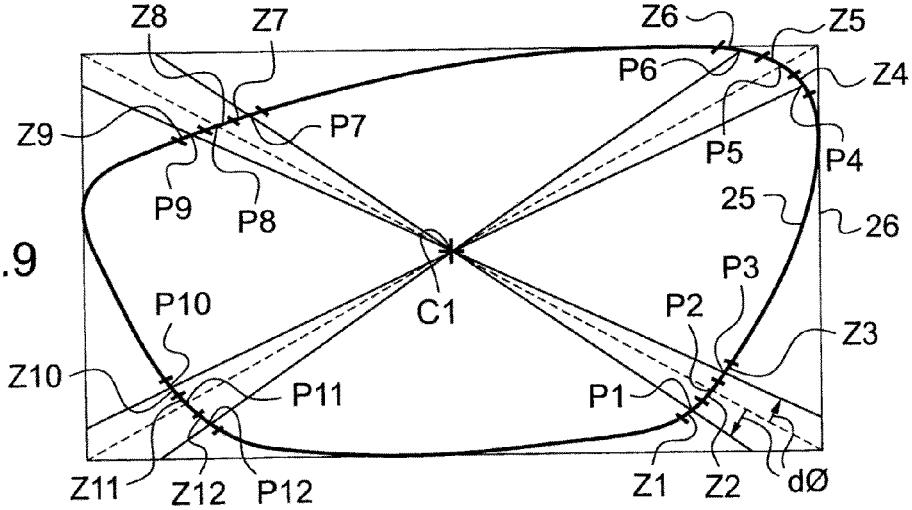
FIGS. 9 to 16 are plan views of the longitudinal profile of the engagement ridge of the FIG. 6 ophthalmic lens and of its singular portions.

For example, with reference to FIG. 9, the calculation means may define a polygon 26 that is inscribed or circumscribed relative to the first or second longitudinal profiles 12, 25; 27 and oriented relative thereto about said central axis A1 as a function of said orientation parameter and may then associate each point of the polygon 26 with a point of the derived longitudinal profile 25 in application of a given correspondence rule, and may finally determine each singular portion Z1-Z12 as a portion that includes a singular point P2, P5, P8, and P11 for which the associated point on said polygon 26 is angular.

As shown in FIG. 9, the polygon in this example corresponds to the boxing frame 26. A point of the derived longitudinal profile 25 is thus defined as being associated with a point of the boxing frame 26 if both points have the same angular position about the central axis A1, i.e. if both of these points are situated on the same straight line passing through the geometrical center C1 of the boxing frame 26. The calculation means then deduce therefrom the positions on the derived longitudinal profile 25 of the four singular points P2, P5, P8, and P11, for which the associated points on the boxing frame 26 correspond to the four corners of the frame. These four singular points are thus situated at the intersections between the derived longitudinal profile 25 and the diagonals of the boxing frame 26.

Once these four singular points have been defined, the calculation means in this example also define eight other singular points P1, P3, P4, P6, P7, P9, P11, and P12 that are situated on either side of each of the four singular points P2, P5, P8, and P11 that were previously defined, each being at a distance d0 therefrom that is equal, in this example, to 5 millimeters along the curvilinear abscissa along the derived longitudinal profile 25.

The calculation means derive therefrom the positions of twelve singular portions Z1-Z12 of the derived longitudinal profile 25 that correspond to the portions of said profile that are centered on the twelve singular points P1-P12, that present lengths that are shorter than 10 millimeters, and that are equal to 5 millimeters in this example.

It can be seen in FIG. 9 that the singular portions Z1-Z12 of the derived longitudinal profile 25 are situated close to particularly highly curved zones of the derived longitudinal profile 25. The special machining of the engagement ridge 24 in these singular portions Z1-Z12 will thus give the surround 11 (not making contact with the engagement ridge 24) free clearance, thereby enabling any errors in the machining of the ophthalmic lens to be accommodated, as explained in greater detail below.

Figure 10:
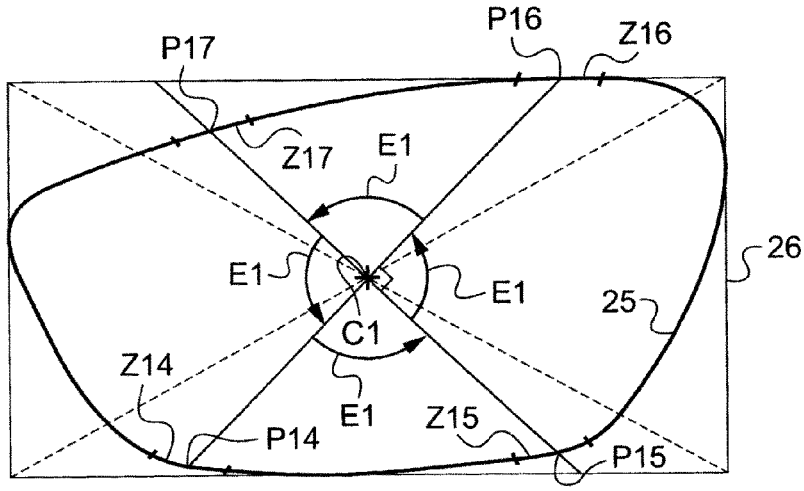

In a variant, and as shown in FIG. 10, in order to determine the positions of the singular portions Z14-Z17 of the derived longitudinal profile 25, the calculation means distribute these singular portions over the profile, starting from a starting point that is determined as a function of said orientation parameter, in such a manner that the singular portions are regularly spaced apart around the central axis A1.

More particularly, the calculation means select a starting singular point P15 amongst the 360 points of the derived longitudinal profile 25, which starting point in this example is situated at 45 degrees relative to the horizon line A2 about the central axis A1 (e.g. the point of index j=46). Thereafter they select as singular points P16, P17, and P14 the three points of the derived longitudinal profile 25 that, together with the starting singular point P15 are spaced apart in pairs about the central axis A1 at a separation angle E1 equal to 90 degrees.

The calculation means derive therefrom the positions of the singular portions Z14-Z17 of the derived longitudinal profile 25 that correspond to the portions of said profile that are centered on the singular points P14-P17 and that present lengths that are equal to 10 millimeters.

It should be observed that in this example likewise, the singular portions Z14-Z17 of the derived longitudinal profile 25 are situated close to particularly highly curved zones of the derived longitudinal profile 25.

Figure 11:
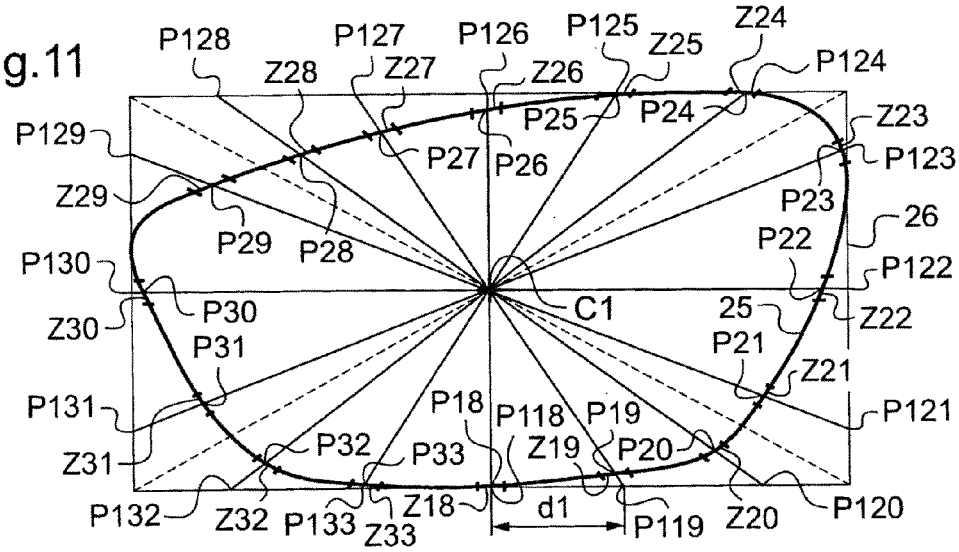

In a variant, and with reference to FIG. 11, in order to determine the positions of the singular portions Z18-Z33 of the derived longitudinal profile 25, the calculation means may distribute a plurality of singular points P18-P33 over the derived longitudinal profile 25 at positions that depend on the shape of a third longitudinal profile 26, which shape is a function of the shape of the derived longitudinal profile 25.

More precisely, the calculation means may distribute a plurality of singular portions Z21-Z31 over the derived longitudinal profile 25 starting from a starting singular point of position that is a function of the orientation parameter, with the singular points being distributed in such a manner that the corresponding zones of the third longitudinal profile 26 are regularly spaced apart along the curvilinear abscissa of said third longitudinal profile 26.

In the variant embodiment shown in FIG. 11, the calculation means select sixteen first singular points P118-P133 that are regularly spaced apart along the boxing frame 26 (which forms the third longitudinal profile), each having the same length d1, and starting from a starting singular point P118 that is situated vertically below the geometrical center C1, beneath the horizon line A2 (point having the index j equal to 1). This starting singular point P118 is thus selected as a function of the orientation parameter, in such a manner that the straight line passing through said singular point and the geometrical center C1 is parallel to the verticality line A3. Thereafter, the calculation means establish a correspondence rule between the points of the boxing frame 26 and the points of the derived longitudinal profile 25. For this purpose, a point of the derived longitudinal profile 25 is defined as being associated with a point of the boxing frame 26 if both points have the same angular position about the central axis A1, i.e. if both points are situated on the same straight line passing through the geometrical center C1 of the boxing frame 26. The calculation means then derive positions over the derived longitudinal profile 25 for sixteen second singular points P18-P33 that an associated with the sixteen first singular points P118-P133 of the boxing frame 26. Finally, the calculation means define as singular portions Z18-Z33 of the derived longitudinal profile 25, the sixteen portions of said profile that are centered around these second singular points P18-P33 and that present predetermined lengths, e.g. equal to 6 millimeters.

Given the large number of singular portions (here equal to sixteen, and at least equal to ten), it can be seen that some of these singular portions are situated close to zones that are particularly highly curved in the derived longitudinal profile 25.

Figure 12:
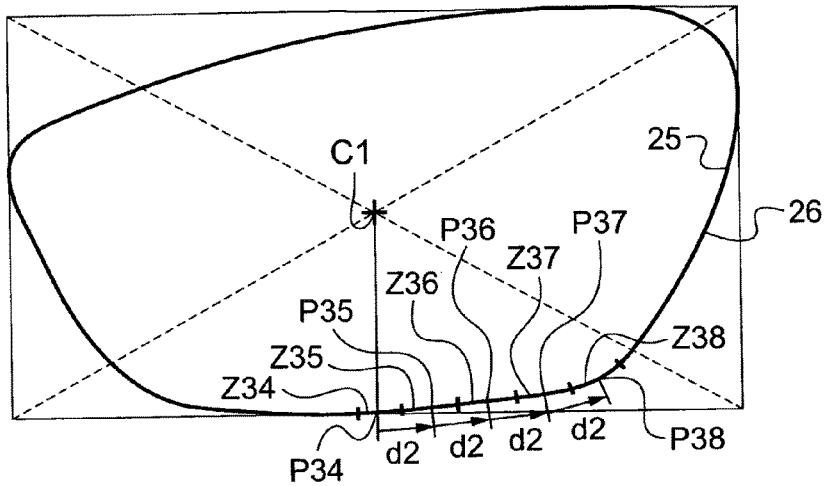

In a variant and with reference to FIG. 12, in order to determine the positions of the singular portions Z34-Z38 of the derived longitudinal profile 25, the calculation means may position a determined number of singular portions that are regularly spaced apart along the curvilinear abscissa of the derived longitudinal profile 25 starting from a starting point that is determined as a function of said orientation parameter.

More precisely, the calculation means select amongst the 360 points of the derived longitudinal profile 25 a starting singular point P34 that is situated in this example vertically below the geometrical center C1, beneath the horizon line (the point of index j=1). Thereafter, they select as singular points P34-P38 the points of said profile that are spaced apart from one another along the curvilinear abscissa by a common distance d2, e.g. equal to one-thirtieth of the total length of the derived longitudinal profile 25.

The calculation means then derive the positions of the thirty singular portions Z34-Z38 of the derived longitudinal profile 25 that correspond to the portions of said profile that are centered on the thirty singular points P34-P38 and that present lengths that are equal, for example, to one-sixtieth of the total length of the derived longitudinal profile 25.

It should be observed that in this example likewise, given the large number of singular portions, some of these singular portions are situated close to zones of the derived longitudinal profile 25 that are particularly highly curved.

Figure 13:
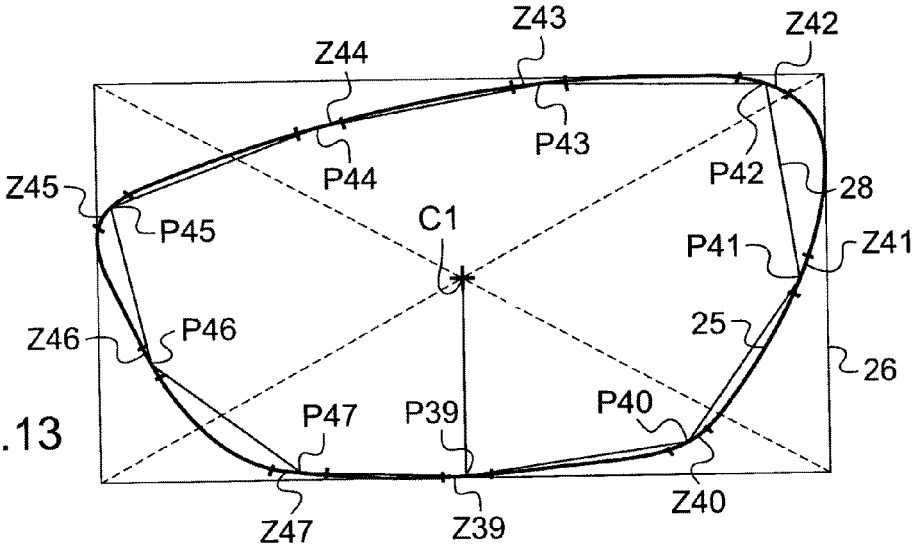

In a variant and with reference to FIG. 13, in order to determine the positions of the singular portions Z39-Z47 of the derived longitudinal profile 25, the calculation means define a polygon 28 that is inscribed in the derived longitudinal profile 25, or in the acquired longitudinal profile 27, and that is oriented relative thereto about said orientation axis A1 as a function of said orientation parameter, and then they determine each singular portion Z39-Z47 as a portion that includes a point belonging to said polygon 28.

More precisely, the calculation means select among the 360 points of the derived longitudinal profile 25 a starting point P39 that, in this example, is situated vertically below the geometrical center C1, beneath the horizon line (the point of index j equal to 1). Thereafter, starting from this starting singular point P39, they calculate the positions of the vertices of a polygon 28 that is inscribed in the derived longitudinal profile 25, having a number of sides that is not less than eight (and is equal to nine in this example), and having sides that present lengths that are identical. Thereafter they select as the singular points P39-P47 of the derived longitudinal profile 25 those points of the profile that are situated at the vertices of the polygon.

The calculation means then derive the positions of the singular portions Z39-Z47 of the derived longitudinal profile 25 that correspond to the portions of said profile that are centered on the singular points P39-P47, and that present a length equal to 5 millimeters, for example.

Given the large number of sides of this polygon, it can be seen that some of the singular portions are situated close to the particularly highly curved zones of the derived longitudinal profile 25.

Figure 14:
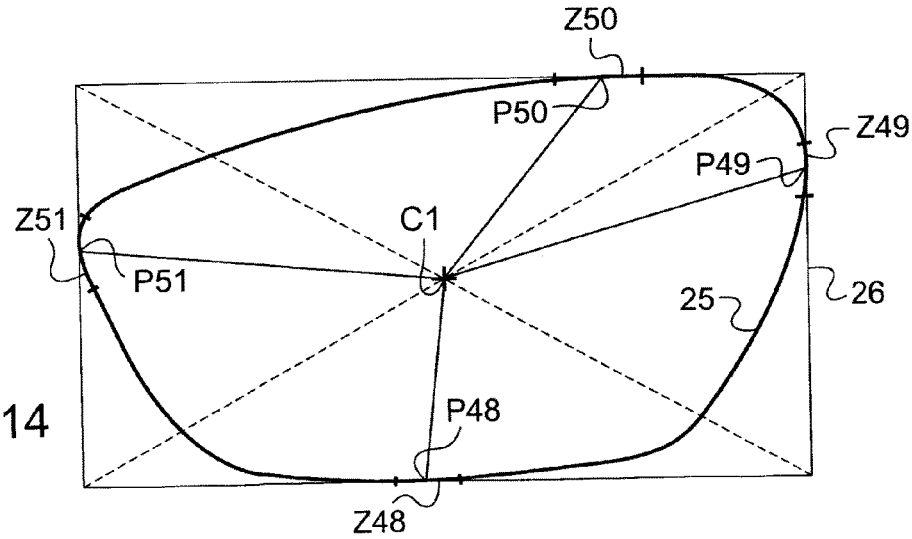

In a variant, and with reference to FIG. 14, in order to determine the positions of the singular portions Z48-Z51 of the derived longitudinal profile 25, the calculation means define a polygon 26 that circumscribes the derived longitudinal profile 25 or the acquired longitudinal profile 27 and that is oriented relative thereto about said orientation axis A1 as a function of said orientation parameter, and then they determine each singular portion Z48-Z51 as a portion that includes a point forming part of said polygon 26.

More precisely, the calculation means determine on the derived longitudinal profile 25 the positions of four singular points P48-P51 that also form part of the boxing frame 26.

The calculation means then derive the positions of the four singular portions Z48-Z51 of the derived longitudinal profile 25 that corresponds to the portions of said profile that are centered on the singular points P48-P51 and that present a length equal to 5 millimeters, for example.

It can be seen that the singular portions Z48-Z51 of the derived longitudinal profile 25 are then situated close to zones of said derived longitudinal profile 25 that are particularly highly curved.

Figure 16:
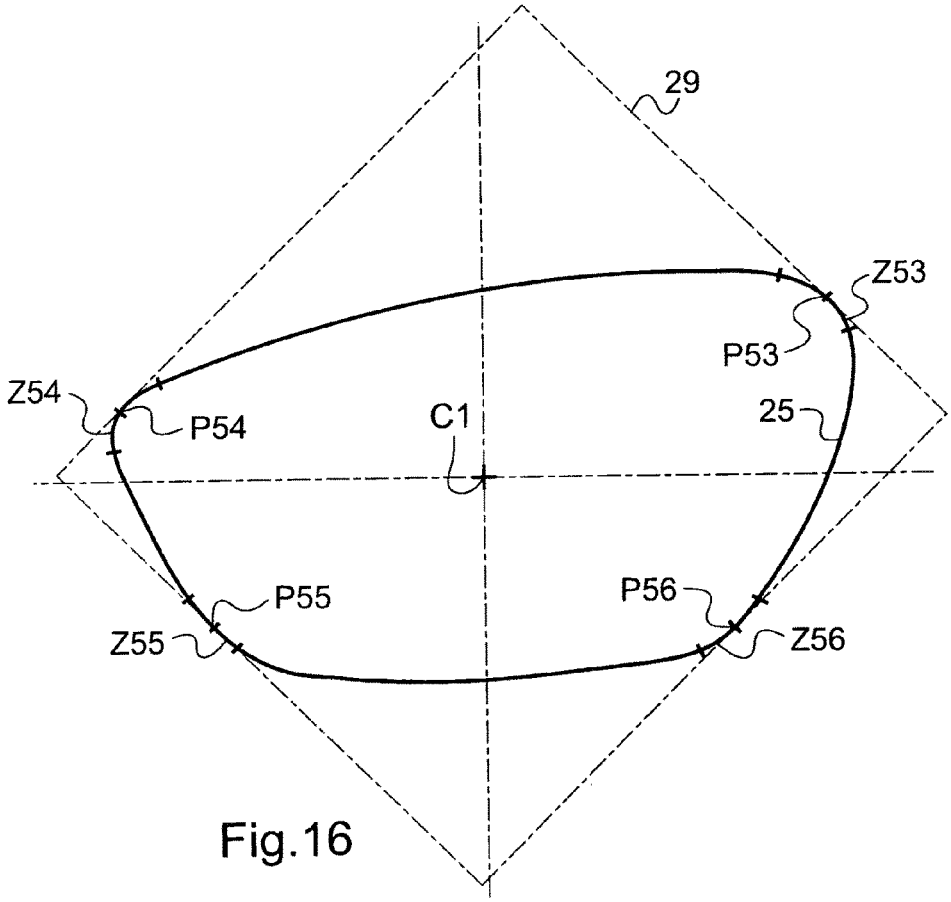

In a variant, and with reference to FIG. 16, in order to determine the positions of the singular portions Z53-Z56 of the derived longitudinal profile 25, the calculation means determine the position of an inclined frame 29 that is circumscribed around the derived longitudinal profile 25 and that has its four sides oriented at 45 degrees relative to the horizon line. Thereafter, they determine over the derived longitudinal profile 25 the positions of the four singular points P53-P56 of said profile that also form parts of the inclined frame 29.

The calculation means then deduce the positions of the singular portions Z53-Z56 of the derived longitudinal profile 25 that correspond to the portions of said profile that are centered on the singular points P53-P56 and that present a length equal to 5 millimeters, for example.

It should be observed that in this example, likewise, the singular portions Z53-Z56 of the derived longitudinal profile 25 are situated close to zones of said derived longitudinal profile 25 that are particularly highly curved.

Figure 15:
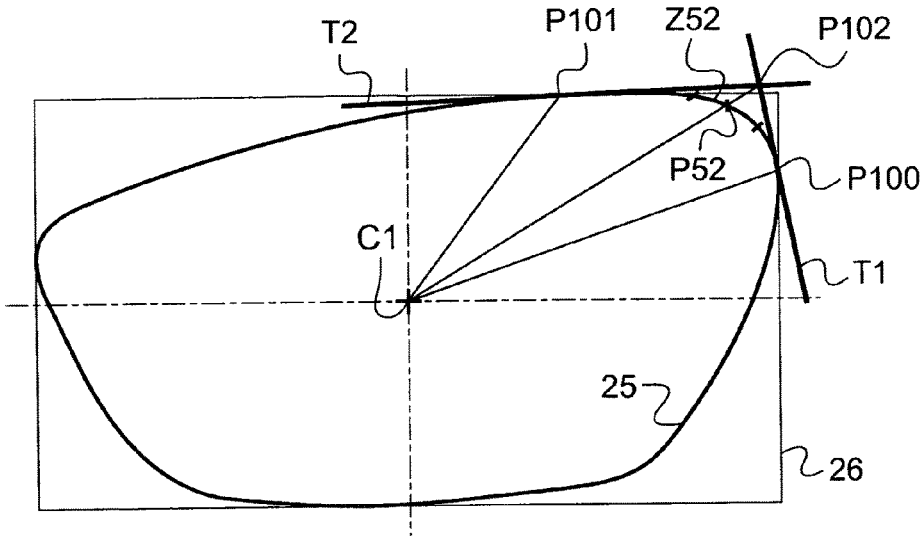

In a variant, and with reference to FIG. 15, in order to determine the position of a singular portion Z52 of the derived longitudinal profile 25, the calculation means acquire the coordinates of the point of intersection P102 between two tangents T1 and T2 to the derived longitudinal profile 25 at two points P100, P101 that are positioned on said profile as a function of said orientation parameter, and then they determine said singular portion Z52 as being the portion that includes the point of the second longitudinal profile 25 that is closest to said point of intersection P102 or that presents an orientation about said central axis A1 that is identical to the orientation of said point of intersection P102.

More particularly, in this example, the calculation means begin by selecting the two points P100, P101 of the derived longitudinal profile 25 that are situated in the temple portion of the profile, above the horizon line, and oriented relative thereto about the central axis A1 at 30 degrees and at 60 degrees (points of index j equal respectively to 121 and 151). Thereafter, the calculation means determine the positions of the tangents T1 and T2 to the derived longitudinal profile 25 at these two points P100, P101, and they deduce therefrom the angular position about the central axis A1 of the point of intersection P102 of these two tangents T1 and T2. Finally, the calculation means define as the singular point P52 of the derived longitudinal profile 25 the point that presents an angular position identical to the angular position of the point of intersection P102.

The calculation means then deduce therefrom the position of the singular portion Z52 of the derived longitudinal profile 25 that corresponds to the portion of said profile that is centered on the singular point P52 and that presents a length equal to 10 millimeters, for example.

In another variant, not shown, in order to determine the positions of the singular portions of the derived longitudinal profile 25, the calculation means read the record in the database registry that contains, in this example, not only the coordinates of points that are representative of the shape of the acquired longitudinal profile 27, but also the coordinates of points that are representative of the shape of the derived longitudinal profile 25 and the positions of each of the singular portions on said derived longitudinal profile 25.

Finally, during a fourth and last step, the shaper appliance 30 proceeds to edge the ophthalmic lens 20. This step is described below with reference to FIG. 9.

In a first implementation of the invention, the lens support shafts 31 and/or the shaper tool 32 are controlled to comply with an edging radius setpoint that differs from the initially provided edging radius setpoint (on the derived longitudinal profile 25) in each of the singular portions Z1-Z12.

For this purpose, the calculation means correct the shape of the derived longitudinal profile 25 in these singular portions Z1-Z12.

In order to obtain the coordinates of the 360 points that are characteristic of this new derived longitudinal profile 27, the calculation means reduce the values of the radial coordinates $rs_j$ of the points of the initial derived longitudinal profile 25 that are situated in the singular portions Z1-Z12. This reduction is implemented in such a manner that the new derived longitudinal profile 27 is continuous and does not present any angular point nor any cusp, and in such a manner that it departs in each singular portion Z1-Z12 from the initial derived longitudinal profile 25 by at least 0.05 millimeters and by at most 0.3 millimeters. The reduction is implemented in this example in such a manner that the maximum departure between the new derived longitudinal profile 27 and the initial derived longitudinal profile 25 is equal to 0.1 millimeters.

The term "angular point" designates a point of a profile having two half-tangents that form an angle that is not flat. Furthermore, the term "cusp" is used to designate a point of a profile having two half-tangents that are opposite. To summarize, the above-mentioned mathematical relationship enabling the coordinates of the points of the initial derived longitudinal profile 25 to be determined as a function of the positions of the points of the acquired longitudinal profile 12 is corrected in the singular portions so as to obtain the coordinates of the points of the new derived longitudinal profile 27. This mathematical relationship is therefore different in the singular portions Z1-Z12 than in the remainder of the new derived longitudinal profile 27, with the difference being such that the mean radius of curvature in each singular portion Z1-Z12 of the new profile 27 is greater than the mean radius of curvature of the initial profile 25 in said singular portion Z1-Z12.

Finally, the lens is edged in conventional manner by means of the main grindwheel 33 of the shaper appliance 30, in such a manner that the top of the engagement ridge 24 (FIG. 7A)

extends along the new derived longitudinal profile 27. The resulting engagement ridge 24 is profiled, i.e. it presents a section that is uniform over its entire length.

To summarize, with reference to the visual equipment comprising the eyeglass frame 10 and the ophthalmic lens engaged in the corresponding surround 11 of said frame, it can be seen that the engagement ridge 24 of the lens possesses firstly sections (FIG. 8A) that are situated outside the singular portions and in which it comes into contact with the bezel 13, and secondly, in alternation therewith, sections (FIG. 8B) that are situated in the singular portions and in which it does not make contact with the bezel.

As a result, when the feeling of the bezel and/or the edging of the lens are performed in imperfect manner, and as a result the outline of the lens is slightly too big relative to the outline of the surround 11, the spaces situated in the singular portions enable the surround to deform, such that the lens remains mountable in the surround.

Advantageously, after the determination step, provision may be made to store the shape of the new derived longitudinal profile 27 in a database registry. For this purpose, the registry may comprise a plurality of records, each of which is associated with a referenced type or model of eyeglass frame and contains the shape of the new derived longitudinal profile 27 that is common to frames of this type or model. The shape of the new derived longitudinal profile 27 is then stored in the registry by searching the registry for a record that corresponds to the frame in question and by writing the shape of the new derived longitudinal profile 27 in that record. In this way, when subsequently edging an ophthalmic lens in order to mount it in a frame of the same type or the same model, the calculation means can acquire the shape of the new derived longitudinal profile from the registry so as to machine this profile directly on the lens.

In a second implementation of the invention, the lens support shafts 31 and/or the shaper tool 32 are controlled in such a manner that the section of the engagement ridge 24 is locally reduced in width and/or in height (FIG. 7B) in the singular portions Z1-Z12.

More precisely, the lens support shafts 31 and/or the shaper tool 32 are controlled to follow the first derived longitudinal profile 25 so as to make on the edge face 23 of the lens 20 an engagement ridge 24 that is profiled, i.e. that is of uniform section, except in the singular portions Z1-Z12.

This embodiment presents a particular advantage. The fact of reducing only the size of the section of the engagement ridge 24 without changing the edging setpoint radius makes it possible to ensure that the distance between the flat beside the engagement ridge 24 (the portion of the edge face 23 of the lens adjacent to the engagement ridge 24) and the inside face of the surround 11 of the eyeglass frame 10 is uniform all around the lens. As a result, no unsightly gap appears between the edge face of the lens and the inside face of the surround 11.

Preferably, the edging of the ophthalmic lens 20 includes a first stage of machining the engagement ridge 24 to have a section that is uniform, and a second stage of paring away the engagement ridge 24 in each free singular portion Z1-Z12.

In this example, the first machining stage is performed using a shaped main grindwheel 33 (shown in FIG. 3) following the derived longitudinal profile 25, while the second stage is performed using the auxiliary grindwheel 35 (shown in FIG. 4).

During this second stage, the beveling groove 36 of the auxiliary beveling grindwheel 35 is brought into contact with the engagement ridge 24 at one end of a first singular portion. Thereafter, the lens support shafts 31 and/or the shaper tool 32 are controlled so that the beveling groove 36 can machine and reduce the height and the width of the engagement ridge 24 in this singular portion. This control is performed in such a manner that the height and the width of the engagement ridge 24 are reduced by at most 0.3 millimeters and in such a manner that the engagement ridge 24 does not present any discontinuity, in particular at the ends of each of the singular portions Z1-Z12.

To summarize, with reference to the visual equipment formed by the edge ophthalmic lens 20, it can be seen that its engagement ridge 24 presents a section that is reduced in width and/or in height in the singular portions Z1-Z12. It can also be observed that this reduction in width and/or in height of the engagement ridge 24 lies in the range 0.05 millimeters to 0.3 millimeters.

It can also be observed that if the section of the engagement ridge 24 has been reduced in height, then the derived longitudinal profile 25 along which the engagement ridge 24 extends is slightly deformed in said singular portions.

This way of shaping the ophthalmic lens 20 is not limiting. In particular, the engagement ridge 24 could be pared away in some other manner.

For example, this may be done during a second pass of the main grindwheel 33, with it being offset in a direction that is substantially parallel to the blocking central axis A1 of the lens, which offset transversely relative to the derived longitudinal profile 25. More precisely, during this second pass, the lens support shafts 31 and/or the shaper tool 32 may be controlled in each singular portion Z1-Z12 in such a manner as to be offset progressively axially (along the central axis A1) from the positions they occupied during the first pass of the main grindwheel 33. Thus, during the second pass, one of the flanks of the engagement ridge 24 is machined by one of the flanks of the beveling groove 34 of the main grindwheel 33, thereby having the effect of reducing both the height and the width of said engagement ridge 24.

In another example, the engagement ridge 24 may be pared away using a singular portion of the main grindwheel 33, by planing down the top of the engagement ridge 24 so as to flatten its top edge, or even locally to eliminate the engagement ridge 24. In this variant, only the height of the engagement ridge 24 is modified.

In another variant of shaping the ophthalmic lens 20, it is possible to shape the flanks and pare away the engagement ridge 24 simultaneously.

More specifically, while beveling the lens using the main grindwheel 33, the lens support shafts 31 and/or the shape tool 32 may be controlled in such a manner as to present axial reciprocating movements (along the central axis A1). Thus, these reciprocating movements enable both flanks of the engagement ridge 24 to be planed away.

In a variant, it is also possible to use the wheel shown in FIG. 5 for the purpose of machining the engagement ridge 24 in two successive stages, a machining stage for machining a first one of its flanks and a machining stage for machining a second one of its flanks.

For this purpose, initially, the electronic and/or computer device of the shaper appliance 30 controls the radial movement of the wheel and/or of the shafts 31 so as to position a first conical end portion 39 of the wheel 37 against the flank 23 of the lens, beside its front face. Thereafter, the wheel 37 and the lens support shafts 31 are controlled so as to form the front flank of the engagement ridge 24. Machining is performed so that the front face of the engagement ridge 24 is situated at a constant distance from the front optical face of the lens 20, except in the singular portions, where it is spaced apart from said face.

Thereafter, the electronic and/or computer device of the shaper appliance 30 controls the radial movement of the wheel and/or of the shafts 31 to position a second conical end portion 38 of the wheel 37 against the edge face of the lens, beside its rear face. The wheel 37 and the lens support shafts 31 are then controlled to form the rear flank of the engagement ridge 24. In this example, this is done in such a manner that the rear flank of the engagement ridge is situated at a constant distance from the front face of the lens, except in the singular portions where it comes closer to the front face. The engagement ridge of the ophthalmic lens thus presents local reduction in height and/or width in each singular portion.

In another variant, the electronic and/or computer device of the shaper appliance 30 may control the radial movement of the machining tool and/or of the shafts 31 in such a manner as not only to reduce the width and/or the height of the section of the engagement ridge 24 in each singular portion, but also to machine the flats beside the engagement ridge 24 (determining the shape of the new longitudinal profile from the shape of the derived longitudinal profile, in a method of the same type as that described above).

Advantageously, provision may be made to store the shape of the derived longitudinal profile 25 in a record of the database registry together with the positions of the singular points along the profile. For this purpose the registry may include a plurality of records, each of which is associated with a referenced type or model of eyeglass frame and contains the shape of a derived longitudinal profile 25 that is common to the frames of this type or this model. The shape of the derived longitudinal profile 25 is then stored by searching the registry for a record that corresponds to the frame in question and by writing the shape of the derived longitudinal profile 25 into this record. In this way, when edging an ophthalmic lens for mounting in a frame of the same model or the same type, the calculation means can acquire the shape of this derived longitudinal profile 25 from the database so as to machine the lens directly with this profile and so as to pare away the singular points.

After said ophthalmic lens has been edged, it is possible to edge a second ophthalmic lens in order to mount it in a second surround of said eyeglass frame 10, by forming a genuinely profiled engagement ridge on its edge face. This ridge may then be made in such a manner as to follow a longitudinal profile that is symmetrical to the derived longitudinal profile 25; 27 such that each of its sections presents a shape that is identical to the shape of the corresponding section (in symmetry) of the engagement ridge 24 of the first lens.

By means of the invention, if the two surrounds of the eyeglass frame 10 are not accurately symmetrical even though both lenses have been machined symmetrically, the spaces that are situated between the engagement ridges of the lenses and the bezels of the surrounds in the singular sections enable both lenses to be mountable in their surrounds.

The present invention is not limited in any way to the embodiments described and shown, and the person skilled in the art knows how to make variations thereto in accordance with its spirit.

In particular, the invention finds an advantageous application when implemented by the clients (opticians) of contractors, i.e. clients who subcontract the fabrication and edging of lenses.

More precisely, consideration is given firstly to a client terminal installed on the premises of a client for ordering lenses and secondly to a manufacturer terminal installed on the premises of a lens manufacturer for fabricating and edging lenses.

The client terminal includes computer means for recording and transmitting order data for the ophthalmic lens 20, e.g. via an Internet protocol (IP) type communications protocol. The order data includes eyesight correcting prescription data (e.g. data concerning optical power, centering, . . . ) and data relating to the frame.

The manufacturer terminal has computer means for receiving and recording the order data transmitted by the client terminal. It also includes a device for fabricating an ophthalmic lens to comply with the prescription data, e.g. provided with means for molding the lens and/or for machining at least one of the optical faces thereof. It also includes a device for shaping the ophthalmic lens in compliance with the data relating to the frame. The shaper device is designed in particular to implement the above-described blocking and edging steps, in one or other of the various implementations described.

The method of preparing lenses is likewise performed in four steps in this example.

During the first step, the client determines a reference for the eyeglass frame 10 and then uses the client terminal to send order data for a lens (the order data including said reference).

The second step is performed by means of a database registry forming part of the manufacturer terminal, in which each record is associated with a type of eyeglass frame 10 and contains firstly a reference for the frame type, secondly the shape of an acquired longitudinal profile 12 common to the surrounds 11 of this type of frame, and thirdly an orientation parameter associated with the profile. During this second step, the manufacturer searches the database registry for the shape and the orientation parameter of the acquired longitudinal profile 12 of the eyeglass frame selected by the wearer (using the reference as determined in the first step). Thereafter, the manufacturer uses a method of the type described above to deduce the shape of the derived longitudinal profile 25 from the shape of this acquired longitudinal profile 12.

Finally, during the third and fourth steps, the manufacturer determines at least one singular portion on the derived longitudinal profile 25 and as a function of said orientation parameter, and then edges the lens in the special manner in each singular portion.

As before, the lens is easily mountable on the first attempt in the frame selected by the wearer. As a result, there is no need for the lens to be returned to the manufacturer in order to be reworked, where any such return is always lengthy and expensive.

In a variant, provision may be made for the step of acquiring the acquired longitudinal profile 12 to comprise two steps, a first step of the client determining the shape of the acquired longitudinal profile 12 together with the associated orientation parameter, e.g. by feeling the surround of the eyeglass frame, and a second step in which the order data including the shape of the acquired longitudinal profile 12 and the orientation parameter is transmitted by the client and received by the manufacturer. In this variant, the positions of the singular portions on the acquired longitudinal profile 12 may be determined equally well by the manufacturer or by the client.

The invention claimed is:

1. A method of preparing an ophthalmic lens (20) for mounting in a surround (11) of an eyeglass frame (10), the method comprising:

an acquisition step of acquiring a first longitudinal profile (12) of said surround (11) and an orientation parameter of said first longitudinal profile (12) relative to a horizon line (A2) or to a verticality line (A3) of said surround (11) about an orientation axis (A1) that is substantially perpendicular to a mean plane of said surround (11); and an edging step of edging the ophthalmic lens (20) with an engagement ridge (24) being formed on its edge face (23), the ridge being generally profiled with a desired section and extending along a second longitudinal profile (25) that is derived from the first longitudinal profile (12) and whose orientation relative to the ophthalmic lens (20) about said orientation axis (A1) is derived from said orientation parameter;

wherein the method includes a determination step of determining at least one singular portion (Z1-Z56) of the second longitudinal profile (25) as a function of said orientation parameter; and in that during the edging step, the engagement ridge (24) is formed so as to present a section that is reduced in width or in height over said singular portion (Z1-Z56).

2. The method according to claim 1, wherein the width or the height of the engagement ridge (24) is/are reduced by at least 0.05 millimeters in at least one section of each singular portion (Z1-Z56).

3. The method according to claim 1, wherein the width and the height of the engagement ridge (24) are reduced by no more than 0.3 millimeters in each singular portion (Z1-Z56).

4. A method of preparing an ophthalmic lens (20) for mounting in a surround (11) of an eyeglass frame (10), the method comprising:

an acquisition step of acquiring a first longitudinal profile (12) of said surround (11) and an orientation parameter of said first longitudinal profile (12) relative to a horizon line (A2) or to a verticality line (A3) of said surround (11) about an orientation axis (A1) that is substantially perpendicular to a mean plane of said surround (11); and an edging step of edging the ophthalmic lens (20) with an engagement ridge (24) being formed on its edge face (23), the ridge being generally profiled with a desired section and extending along a second longitudinal profile (27) that is derived from the first longitudinal profile (12) and whose orientation relative to the ophthalmic lens (20) about said orientation axis (A1) is derived from said orientation parameter;

wherein the method includes a determination step of determining at least one singular portion (Z1-Z56) of the second longitudinal profile (27) as a function of said orientation parameter; and in that during the edging step, the engagement ridge (24) is formed so that the second longitudinal profile (27) is derivable from the first longitudinal profile (12) by a mathematical relationship that is different over said singular portion (Z1-Z56) than for the remainder of the second longitudinal profile (27) in such a manner that the mean radius of curvature of said singular portion (Z1-Z56) of the second longitudinal profile (27) is increased relative to the mean radius of curvature that said singular portion (Z1-Z56) would have presented if said mathematical relationship had been the same over said singular portion (Z1-Z56) as over the remainder of the second longitudinal profile (27).

5. The method according to claim 4, wherein said singular portion (Z1-Z56) of the second longitudinal profile (27) presents at at least one point a departure of more than 0.05 millimeters from the shape that said singular portion (Z1-Z56) would have presented if the mathematical relationship over said singular portion (Z1-Z56) had been the same as for the remainder of the second longitudinal profile (27).

6. The method according to claim 4, wherein the singular portion (Z1-Z56) of the second longitudinal profile (27) presents at all points a departure of less than 0.3 millimeters from the shape that said singular portion (Z1-Z56) would have presented if the mathematical relationship over said singular portion (Z1-Z56) had been the same as for the remainder of the second longitudinal profile (27).

7. The method according to claim 4, wherein, during the edging step, the engagement ridge (24) is formed so as to present a uniform geometrical section along the second longitudinal profile (27).

8. The method according to claim 1, wherein during the edging step, the engagement ridge (24) is formed to present a profile that is continuous, without any angular point and without any cusp.

9. The method according to claim 1, wherein each singular portion (Z1-Z56) presents a length of less than 10 millimeters.

10. The method according to claim 1, wherein, in order to determine each singular portion (Z1-Z56), a polygon (26; 28) is defined that is inscribed or circumscribed relative to the first or the second longitudinal profile (12, 25; 27) and that is oriented relative thereto about said orientation axis (A1) as a function of said orientation parameter, each point thereof being associated with a point of the second longitudinal profile (25; 27) in application of a given correspondence rule, and then each singular portion (Z1-Z56) is determined as a portion that includes a point for which the associated point on said polygon (26; 28) is an angular point.

11. The method according to claim 1, wherein, in order to determine each singular portion (Z1-Z56), a polygon (26; 28; 29) is defined that circumscribes the first or the second longitudinal profile (12, 25; 27) and that is oriented relative thereto about said orientation axis (A1) as a function of said orientation parameter, and then each singular portion (Z1-Z56) is determined as a portion including a point forming part of said polygon (26; 28; 29).

12. The method according to claim 1, wherein, in the determination step, a predetermined number of singular portions (Z1-Z56) are positioned that are regularly spaced apart along the curvilinear abscissa of the second longitudinal profile (25; 27) starting from a starting point that is determined as a function of said orientation parameter.

13. The method according to claim 1, wherein, in the determination step, a predetermined number of singular portions (Z1-Z56) are positioned that are regularly spaced apart around an axis of the lens passing inside the second longitudinal profile (25; 27), starting from a starting point that is determined as a function of said orientation parameter.

14. The method according to claim 1, wherein, in the determination step, the point of intersection (P102) between two tangents (T1, T2) to the second longitudinal profile (25; 27) at two points (P100, P101) is acquired, those two points being positioned on said second longitudinal profile (25; 27) as a function of said orientation parameter, and then said singular portion (Z1-Z56) is determined as a portion including the point of the second longitudinal profile (25; 27) that is the closest to said point of intersection (P102) or that presents an orientation about said orientation axis (A1) that is identical to the orientation of said point of intersection (P102).

15. The method according to claim 1, wherein after the determination step, a search is made in a database registry in which each record is associated with a referenced type of eyeglass frame (10) that contains the shape of the second longitudinal profile (25; 27) for a record corresponding to the frame in question, and the positions of each of the singular portions (Z1-Z56) on the second longitudinal profile (25; 27) are written to said record.

16. The method according to claim 1, wherein during the acquisition step, a record is read from a database registry in which each record is associated with a referenced type of eyeglass frame (10) that contains firstly the shape of the first acquired longitudinal profile (12) of the bezel (13) corresponding to the referenced type of eyeglass frame, and secondly said orientation parameter.

17. The method according to claim 1, including an edging step of edging a second ophthalmic lens in order to mount it in a second surround of said eyeglass frame (10) by forming a generally profiled engagement ridge on its edge face, which ridge extends along a given longitudinal profile that is symmetrical to said second longitudinal profile (25; 27) and in which each section presents a width or a height identical to the width or the height of the symmetrically corresponding section of the engagement ridge (24) of said first ophthalmic lens (20).

18. The method according to claim 1, implemented by means of a system comprising firstly a client terminal installed beside a client and including computer means for recording and transmitting order data concerning the ophthalmic lens (20), said order data including data relating to the eyeglass frame (10), and secondly a manufacturer terminal installed beside a manufacturer and including computer means for receiving and recording the order data transmitted by the client terminal, and a shaper device for edging said fabricated ophthalmic lens, the device being designed to implement said edging step, said acquisition step comprising:

a determination step of the client determining the first longitudinal profile (12) of the surround (11) of the eyeglass frame (10) and of said orientation parameter; and an ordering step of the client terminal sending order data and of the manufacturer terminal receiving said data, said data incorporating said first longitudinal profile (12) and said orientation parameter.

19. The method according to claim 1, implemented by means of a system comprising firstly a client terminal installed beside a client and including computer means for recording and transmitting order data concerning the ophthalmic lens (20), said order data including data relating to the eyeglass frame (10), and secondly a manufacturer terminal installed beside a manufacturer and including computer means for receiving and recording the order data transmitted by the client terminal, a shaper device for edging said fabricated ophthalmic lens, the device being designed to implement said edging step, said acquisition step comprising:

a determination step of the client determining a reference of the eyeglass frame (10); and an ordering step of the client terminal sending order data and of the manufacturer terminal receiving said data, said data incorporating said reference; and a searching step of the manufacturer terminal searching, in a database registry in which each record is associated with a type of eyeglass frame (10) and contains a reference for said frame and the first longitudinal profile (12) of the surround (11) of said frame, and said orientation parameter, for a record associated with the frame reference in question.

20. The method according to claim 4, wherein during the edging step, the engagement ridge (24) is formed to present a profile that is continuous, without any angular point and without any cusp.

21. The method according to claim 4, wherein each singular portion (Z1-Z56) presents a length of less than 10 millimeters.

* * * * *